US008192271B2

(12) United States Patent
Naicker et al.

(10) Patent No.: US 8,192,271 B2
(45) Date of Patent: Jun. 5, 2012

(54) DISPLAY OF BONUS GAME PROGRESSION IN REEL-TYPE GAMES

(75) Inventors: Theo Naicker, Durban (ZA); Terence Igesund, Durban (ZA); Richard Vermaak, Mount Edgecombe (ZA)

(73) Assignee: Waterleaf, Ltd., Douglas (IM)

( * ) Notice: Subject to any disclaimer, the term of this patent is extended or adjusted under 35 U.S.C. 154(b) by 926 days.

(21) Appl. No.: 11/978,876

(22) Filed: Oct. 29, 2007

(65) Prior Publication Data

US 2009/0111566 A1 Apr. 30, 2009

(51) Int. Cl.
*A63F 9/24* (2006.01)

(52) U.S. Cl. ..... 463/20

(58) Field of Classification Search ..... 463/16–22
See application file for complete search history.

(56) References Cited

U.S. PATENT DOCUMENTS

| | | | | |
|---|---|---|---|---|
| 4,836,553 | A | 6/1989 | Suttle et al. | 273/292 |
| 4,948,134 | A | 8/1990 | Suttle et al. | 463/13 |
| 5,374,067 | A | 12/1994 | Jones | 273/292 |
| 5,848,932 | A | 12/1998 | Adams | 463/20 |
| 6,336,863 | B1 | 1/2002 | Baerlocher et al. | 463/27 |
| 6,364,313 | B1 | 4/2002 | Moody | 273/138.1 |
| 6,398,218 | B1 * | 6/2002 | Vancura | 273/138.1 |
| 6,419,578 | B1 | 7/2002 | Moody et al. | 463/13 |
| 6,485,368 | B2 | 11/2002 | Jones et al. | 463/13 |
| 6,565,434 | B1 | 5/2003 | Acres | 463/25 |
| 6,752,395 | B2 | 6/2004 | Jones et al. | 273/292 |
| 6,800,030 | B2 | 10/2004 | Acres | 463/25 |
| 6,910,964 | B2 | 6/2005 | Acres | 463/25 |
| RE38,812 | E | 10/2005 | Acres et al. | 463/26 |
| 6,955,600 | B2 * | 10/2005 | Glavich et al. | 463/20 |
| 2002/0016200 | A1 * | 2/2002 | Baerlocher et al. | 463/20 |
| 2003/0078089 | A1 * | 4/2003 | Gray et al. | 463/16 |
| 2003/0216165 | A1 * | 11/2003 | Singer et al. | 463/20 |
| 2004/0132527 | A1 * | 7/2004 | Berman et al. | 463/18 |
| 2005/0070353 | A1 * | 3/2005 | Webb et al. | 463/16 |
| 2005/0075159 | A1 * | 4/2005 | Kaminkow et al. | 463/16 |
| 2005/0075163 | A1 * | 4/2005 | Cuddy et al. | 463/20 |
| 2005/0130732 | A1 | 6/2005 | Rothschild et al. | 463/20 |
| 2006/0009277 | A1 * | 1/2006 | Hartl et al. | 463/20 |

(Continued)

OTHER PUBLICATIONS

Pop-O-Matic Trouble Game Instruction Booklet, Hasbro 2002, retrieved at http://www.hasbro.com/customer-service/toy-game-instructions.cfm.*

(Continued)

*Primary Examiner* — Melba Bumgarner
*Assistant Examiner* — Anh Vo V Nguyen
(74) *Attorney, Agent, or Firm* — McDonnell Boehnen Hulbert & Berghoff LLP

(57) ABSTRACT

Reel-type games are described in which a player's progress towards an award of a bonus game is displayed to the player. The required triggering event for an award of a bonus game may be accumulated over multiple turns of the game. A bonus indicator (e.g., icon) is provided on the display in association with each reel of the reels. After a spin of the reels, the bonus indicator for a given reel is activated if a symbol associated with an award of a bonus game is presented on the given reel. As the player continues to play, whenever the symbol associated with the bonus game appears for the first time on a given reel, the associated bonus indicator is activated and remains activated. When all the indicators have become activated, a bonus game is awarded to the player.

22 Claims, 6 Drawing Sheets

U.S. PATENT DOCUMENTS

| | | | | |
|---|---|---|---|---|
| 2007/0117610 | A1* | 5/2007 | Webb et al. | 463/17 |
| 2009/0048010 | A1* | 2/2009 | Kroeckel et al. | 463/13 |
| 2010/0016071 | A1* | 1/2010 | Jaffe et al. | 463/27 |

OTHER PUBLICATIONS

CindyJean, Milton Bradley Trouble. Epinions.com [online], Oct. 5, 2001 [retrieved on Sep. 2, 2011]. Retrived from the Internet: <URL: http://www.epinions.com/review/Milton_Bradley_Trouble/content_42532310660>.*

Extended European Search Report dated Feb. 11, 2009, in European Application No. EP 08 25 3521.

U.S. Appl. No. 11/373,748, filed Mar. 9, 2006.

Published PCT Application WO 2006/027677 of Waterleaf Limited, published Mar. 16, 2006.

Extended European Search Report in EP Application No. 07250996.1, dated Jun. 29, 2007.

* cited by examiner

DISPLAY OF BONUS GAME PROGRESSION IN REEL-TYPE GAMES

STATEMENT REGARDING FEDERALLY SPONSORED RESEARCH OR DEVELOPMENT

Not applicable.

BACKGROUND

This disclosure relates generally to the field of wager games and more particularly to methods and apparatus for providing notice to a player of their progression towards an award of a bonus game during play of a reel-type wager game. The methods are applicable in a variety of game playing formats, for example physical slot machines, electronic video gaming terminals, and computer workstations playing wager games over a computer network.

In reel-type games such as slots, one or more reels are provided, each of which contain a multitude of symbols distributed around the circumference of the reel. When a player places a wager (e.g., by placing a coin in the machine) they are then permitted to spins the reels. Each reel comes to rest, with typically with either one of the symbols, or a space in between the symbols, in alignment with a pay line. The player wins according to whether a particular winning symbol or combination of symbols is present on the pay line. In a simple three-reel slot machine game, the pay line is the horizontal line going across the middle of the reels. In other reel-type games, such as an array of 5×3 symbols which all "spin" during a turn of play, the "pay line" refers to a particular combination of positions of symbols in the 5×3 array which are used to determine if a winning result was achieved.

The game of slots can be played on a video gaming terminal with a graphical user interface, e.g., a dedicated gaming machine such as found in a casino. In the case of a video gaming terminal, the user interface displays an image of a set of reels. Animation effects are used to simulate the spinning action. A computer software program, which may be resident in the video gaming terminal, randomly generates a result for a simulated spin of the reels, and the result is presented on the user interface.

Slots games are also played over a computer network, e.g., by a player using a personal computer which has established a connection to a gaming server. In this later situation, the gaming server generates results of play and transmits the results over the computer network to the computer for display.

The popularity of video slot games has increased due to the incorporation of bonus games into such video slot games. A bonus game is generally distinct from the underlying video slot game and provides a player with entertainment, and also additional opportunities to win game prizes.

The play of bonus games may utilize the reels of the video slot game itself ("reel-based bonus games"), or, alternatively, may occur on a separate bonus screen ("non-reel-based bonus games").

The most common reel-based bonus game consists of an award of "free spins", in which the player is provided with a quantity of further play of the underlying video slot game at no cost to the player, while at the same time allowing the player to win game prizes in the usual manner. For purposes of determining a payout for a winning result in accordance with a pay table, the amount wagered per spin during a "free spins" game is typically fixed, e.g. at $1.00, but again, the "free spins" do not result in the player's account being debited.

Other types of reel-based bonus games feature the addition of wild multipliers in the reels, randomly-changing symbols, cascading features where winning combinations of symbols disappear and are replaced by further symbols, "expanding wilds" where a wild symbol replicates to cover an entire reel of the video slot game on which it appears, and slide features in which a reel symbol replicates across multiple reels.

Non-reel-based bonus games allow game designers unlimited scope for creativity. The simplest such bonus game is a "pick-a-box" feature in which the player is presented with a number of choices and has to select items in order to win prizes. A variation of this bonus game is the so-called "Pick until Pop" game in which the player continues to select items until a terminating item is selected. A further category of non-reel-based bonus games is based on a wheel spin in which a player is awarded a prize that is a function of a position at which the wheel comes to rest. Another category of non-reel-based bonus games is multi-level games in which selection of a correct item allows the player to progress to a higher level of prizes that may also include a progressive jackpot.

It is also known for a single underlying video slots game to have a combination bonus game comprising both reel-based bonus features and non-reel-based bonus features, such as the features described in the previous paragraph.

The underlying video slot game requires a trigger event to occur in order to launch the bonus game. Various types of trigger events are known in the art. One type of trigger event is the occurrence of a predefined combination of trigger symbols on a pay line of the underlying video slot game. This combination of trigger symbols which must be present to trigger the launch of the bonus game is usually included in the pay table of the video slot game. For example, the bonus game may be triggered by a game outcome in which three or more trigger symbols appear on any active pay line of the underlying video slot game. Alternatively, the required number of trigger symbols need not all appear on a single pay line, but could be scattered in any positions in the reel display area of the video slot game. As a further alternative, the bonus game may be triggered randomly. As a yet further alternative, the bonus game may be triggered by the occurrence of a "wind-up" in which the appearance of a predetermined combination of symbols on a subset of the reels of the video slots game initiates a random outcome on the remaining reels of the game. In all of these prior art scenarios, the bonus game is triggered based on the results of a single play or spin of the underlying video slot game.

SUMMARY

In a first aspect, a machine configured to play a reel-type wager game featuring a bonus game is described. The machine can take the form of a video slots machine, a general purpose computer or other type of machine used to play games. The machine includes a display configured to display two or more reels of a reel-type wager game, a memory storing software instructions for facilitating a user to play the reel-type wager game, and a processor for executing the software instructions. The software features instructions for displaying on the display a bonus indicator associated with each of the two or more reels. The bonus indicator, which may take the form of an icon or graphical device of any sort, becomes active when the respective reel displays a symbol associated with an award of a bonus game. The symbol may take any form and could for example be a star symbol, the letter "B" or the word "Bonus". The bonus game is typically triggered when the bonus indicators associated with at least two of the reels become active.

Progression towards the bonus game is initially set to none when the player starts play for the first time. The player reaches a first stage of progress towards the bonus game when the symbol associated with the bonus game appears on the pay line one of the reels, with the bonus indicator for that reel becoming active to indicate such progress. In an example of a three reel game, when the symbol associated with the bonus game appears on the pay line of a second reel, the bonus indicator for that second reel becomes active. Thus, the player is now two-thirds of the way towards the bonus game. When the symbol associated with the award of the bonus game appears on the third reel, the bonus indicator on the third reel becomes active and the player has achieved the bonus game.

In one embodiment, the machine is connected to a computer network and the machine is configured to receive results of spins of the reels from a gaming server over the computer network. In other forms of the invention, the machine can be a completely stand alone machine and have software resident in the machine that determines results of spins of the reels. As one further example, the machine may take the form of a video gaming terminal. In some forms of the game the display is configured to display N reels, where N is an integer greater than three, each of the reels having an associated bonus indicator. In other forms, the results of a spin or turn of the reel-type game are displayed in the form of an array of symbols in M rows and N columns, each column of the N columns is in the form of a reel. In one specific form of the game, if the symbol associated with the bonus game appears on any of the M rows in any of the N columns (any of the reels), the bonus indicator for that column (reel) becomes active.

In another aspect, a gaming server is disclosed which communicates with a machine playing a reel-type game over a computer network. The gaming server generates results of a spin of each of a plurality of reels in the reel-type game for the machine and transmits such results to the machine as a datagram over the computer network. The gaming server features a memory storing data representing potential results for each of the reels (e.g., an array of symbols such as cherries, bar, Bar Bar, 7, etc.), with the potential results also including a result in the form of a symbol which is associated with progress towards an award of a bonus game. Should a given spin of the reels for a machine result in this symbol associated with progress towards an award of a bonus game, when the machine receives the result from the gaming server the machine will then activate the bonus indicator for the respective reel in which this result was obtained, as described herein.

In one particular embodiment, a player can "bank" the progress that was achieved towards the bonus game in the event that the player leaves the game. Thus, in this embodiment the gaming server is further provided with a memory storing data (e.g., a flag or bit) indicating whether a result of a spin of the reels for the workstation has included the symbol. The gaming server stores such data in the memory after the workstation has ceased play of the game. Should the player later rejoin the game, the server retrieves the data and sends it in a datagram to the workstation. The workstation then activates the bonus indicators for the respective reels and the player basically starts play again with their accumulated progress to the bonus game displayed on the display.

In one embodiment of this disclosure, the potential result for each of the reels is a deactivation symbol, wherein should this symbol be the result for a given spin any previous progress towards an award of bonus game associated with the reel having such deactivation symbol is negated. Thus, for example if a previous turn of the reel had resulted in the symbol associated with the bonus game, the bonus indicator would become active. However, if the later turn yielded the deactivation symbol, the bonus indicator for that reel is then deactivated.

In still another aspect, a method is disclosed of playing a reel-type game using a machine having a display. The method includes the steps of providing on the display a plurality of reels, and providing a trigger mechanism for initiation of a bonus game in which the required trigger conditions can be accumulated progressively over multiple turns of the game. In one embodiment, the method further includes the step of providing on the display a visible indication of progress being made towards initiation of the bonus game, with the progress being accumulated when a symbol associated with the bonus game is presented on any one of the plurality of reels as a result of a turn of the play of the reel-type game.

As noted above, the display of the visual indication of progress may take the form of displaying a bonus indicator on the display. The display can be configured to display N reels, where N is an integer greater than or equal to three, and wherein each of the N reels has an associated bonus indicator. In other forms, the results for the reel-type game are displayed in the form of an array of symbols in M rows and N columns, each column of the N columns comprising a reel and each reel having its associated bonus indicator.

DETAILED DESCRIPTION

Reel-type games are disclosed which provide the player with a visible indication of progress being made towards initiation of a bonus game, thereby heightening anticipation and increasing excitement of the game. This is achieved by providing a trigger mechanism for initiation of a bonus game in which the required trigger conditions can be achieved (i.e. accumulated or collected) over multiple turns or spins of the video slot game, and by providing a display of the progress towards meeting the trigger conditions to the player directly on the display of the game.

The games of this disclosure are typically played on a machine which is configured to play a reel-type wager game featuring a bonus game. The machine includes a display configured to display two or more reels of a reel-type wager game, a memory storing software instructions for facilitating a user to play the reel-type wager game, and a processor for executing the software instructions. The software features instructions for displaying on the display a bonus indicator associated with each of the two or more reels. The bonus indicator, which may take the form of an icon or graphical device of any sort, becomes active when the respective reel displays a symbol associated with an award of a bonus game. The symbol may take any form and could for example be a star symbol, the letter "B" or the word "Bonus". The bonus game is typically triggered when the bonus indicators associated with at least two of the reels become active.

This is best illustrated by example with reference to a sequence of screen shots shown in FIGS. 1-4. These screen shots show a display on a user interface (10) of a game playing machine used for playing a reel-type game. The machine may take the form of a video gaming terminal, a slot machine, general purpose computer, personal digital assistant, cellular telephone, or other electronic device. The device includes a memory storing software instructions (not shown but conventional in such machines) and a processing unit (e.g., CPU or microprocessor) which executes the instructions stored in the machine, which again is conventional. The sequence and organization of the software instructions will be apparent to persons skilled in the art from the description and illustrated examples of operation of the various embodiments of the invention set forth below.

Figure 1:
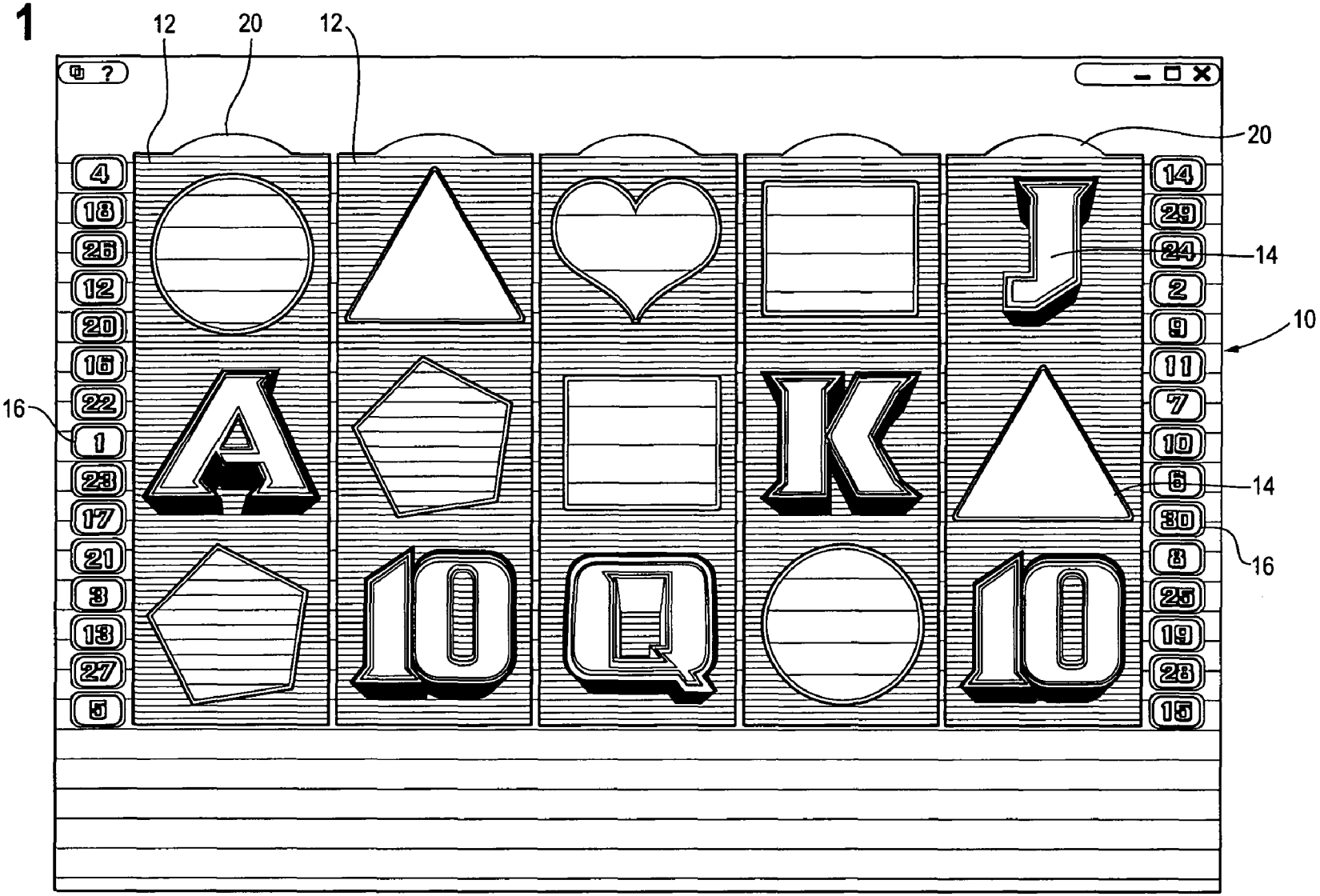
FIG. 1 is an illustration of the display of a machine used to play a reel-type wager game. Each reel has an associated indicator which becomes active when a particular symbol associated with an award of bonus play is present in the reel.

In particular, FIG. 1 is a representation of a five-reel video slot game which is presented on the display (10) of the game playing machine. The symbols (14) are displayed in an array of symbols (14) in M rows and N columns, here M=3 and N=5. Each column is in the form of a reel (12). Each reel (12) displays three symbols after a turn of the game. The game has up to thirty pay lines, each comprising a unique sequence of array elements (14) going from left to right across the display, each pay line having an associated number. The pay line numbers are represented by item (16). The pay lines in a game of this type are known in the art and the details are not particularly important. Each of the five reels (12) has an associated bonus indicator (20), which is represented as a bubble (or protrusion) at the top of the slot reel (12). For reasons which will become clear, the shape or nature of the bonus indicator (20) is not particularly important.

The purpose of the indicators (20) is to indicate the progression of the player towards an award of a bonus game, e.g., initiation of a bonus mode of the game. The reel indicators (20) in FIG. 1 are all shown in an inactive state, that is, they are present on the display but not lit up or given any special color or animation effects. In one possible embodiment they could remain hidden an only appear when progress towards a bonus game is achieved.

Figure 2:
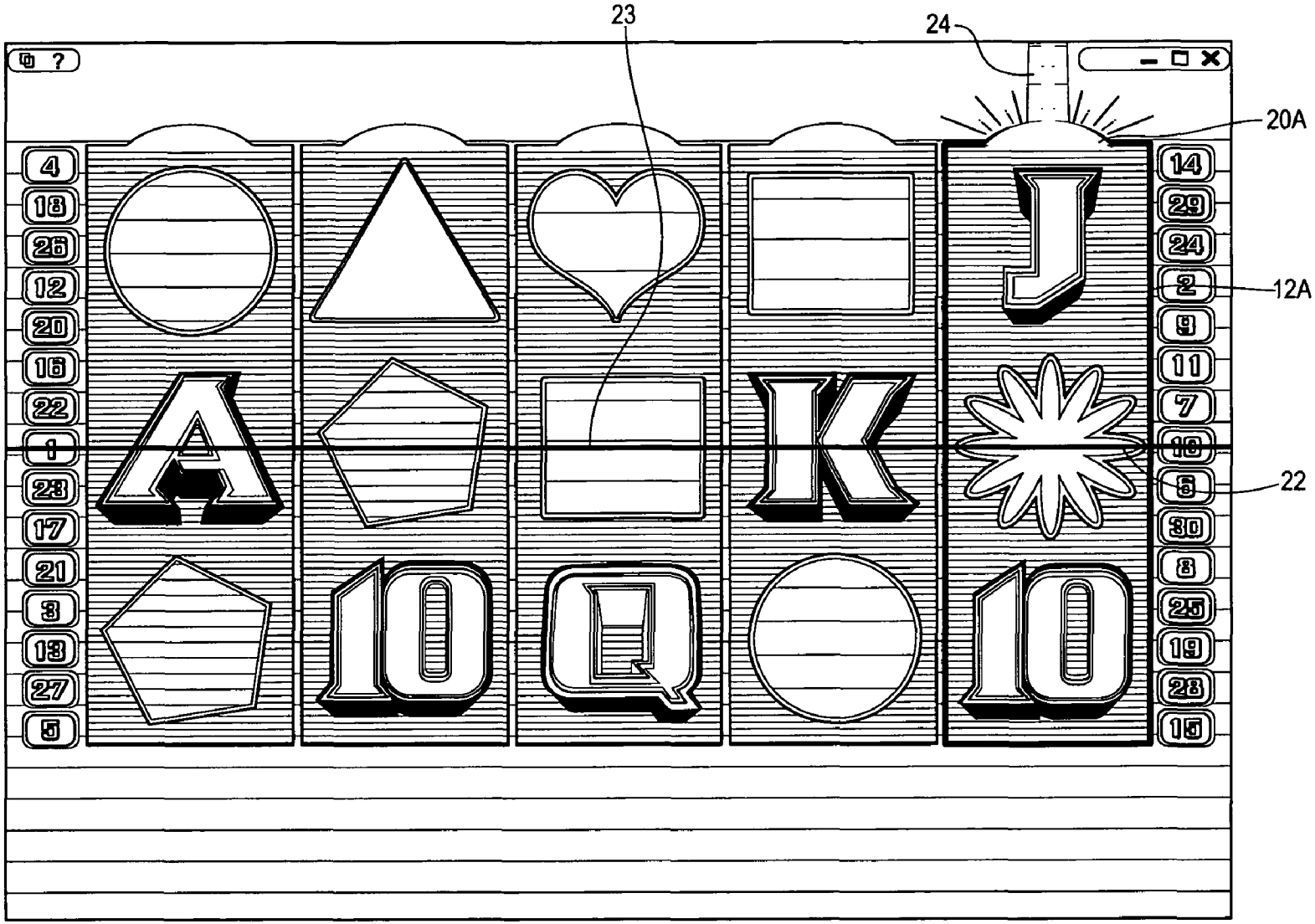
FIG. 2 is an illustration of the display of FIG. 1 after a spin of the reels. The bonus indicator for the far right-hand reel has become activated due to the star symbol being present on the far right-hand reel.

The set of symbols (14) of the video slot game contains a "passport" or triggering symbol associated with an award of a bonus game, represented in FIG. 2 by the star symbol (22). During regular play of the video slot game, whenever a passport symbol (22) appears on the center pay line (23) of the reel display area, the bonus indicator (20) of the reel (12) in which the passport symbol (22) occurred becomes active. In FIG. 2, the passport symbol (22) has appeared on the fifth reel (12A) of the video slot game and the indicator (20A) associated with the fifth reel has become active. The manner of activating the indicator (20A) is not particularly important and can vary widely. In this particular instance, the indicator (20A) is in the form of a bubble which becomes illuminated and an illuminated line (24) extends upwards from the indicator (20A).

As game play progresses and further spins of the reels occur, the indicator 20A associated with the fifth reel (12A) remains highlighted. In other words, the game is structured such that a player's progression towards an award of a bonus game is preserved from spin to successive spin. In theory, the progression could be preserved as long as the player continues to play in one continuous session. It is also possible to "bank" the progress towards the award of the bonus game should the play quit playing and resume playing later, as will be described in further detail later on.

Suppose in the example of FIGS. 1 and 2 the player continues to play after the activation of the bonus indicator (20A) in FIG. 2. Suppose further in this example that the player kept playing until the passport symbol (22) has appeared on the third reel 12C. See FIG. 3. At this point, the bonus indicator (20C) associated with the third reel (12C) is now highlighted or active, i.e., it becomes illuminated and an illuminated line (24) extends upwards from the indicator (20C). Note further that the bonus indicator (20A) for the fifth reel (12A) has remained highlighted, indicating that the progression toward a bonus game achieved in the spin of FIG. 2 is preserved. This is true even though the particular spin resulting in the display of FIG. 3 did not include the passport symbol (22) in the fifth reel (12A).

Suppose, in this example, that the player continues to play. Consider now FIG. 4. In this particular spin of the game the passport symbols (22) have appeared on the remaining (i.e. first, second and fourth) reels (12). Now, all of the reel indicators (20A, 20B, 20C, 20D and 20E) are highlighted. In this particular version of the game, the rules of the game are such that the player has to have all five indicators (20) activated in order to trigger a bonus game. Since all five indicators (20) are active, the bonus game is awarded. The award of the bonus game may optionally be indicated by a message (30) informing the player of the award.

Figure 3:
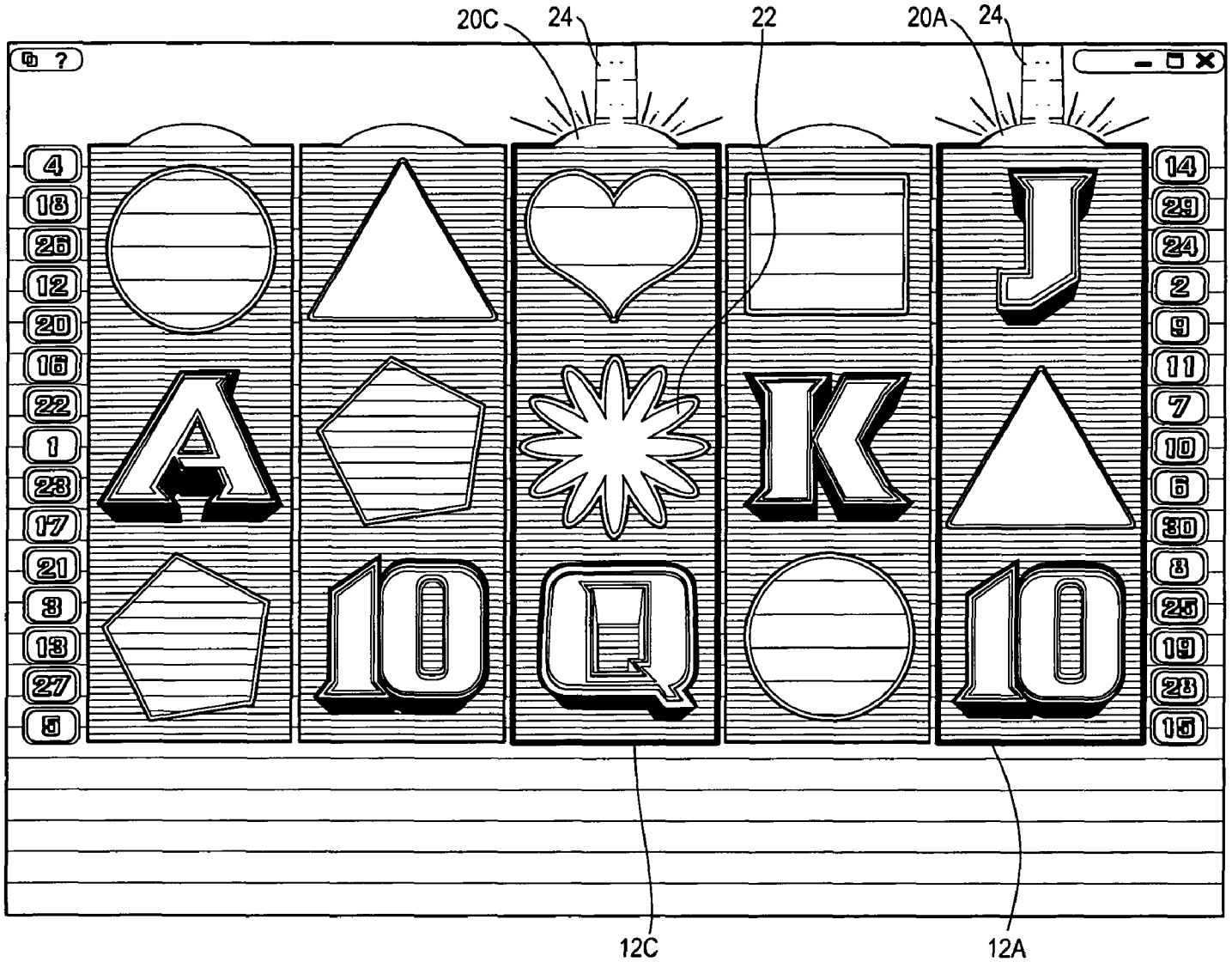
FIG. 3 is an illustration of the display of FIG. 1 after a further spin of the reels from that shown in FIG. 2. The bonus indicator for the far right-hand reel remains activated. Additionally, the bonus indicator for the middle reel has also become activated due to the star symbol being present on that reel during this spin of the reels.
Figure 4:
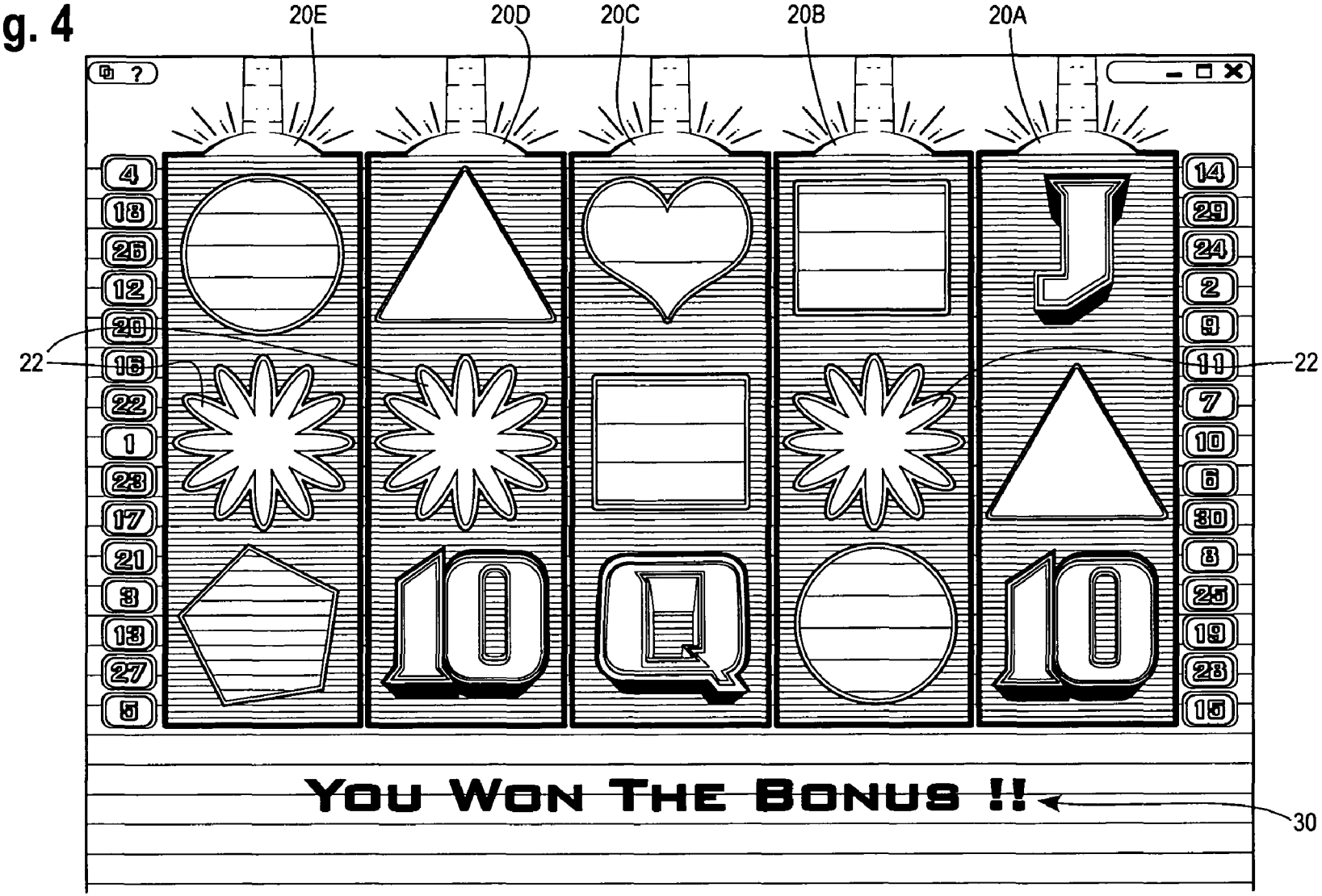
FIG. 4 is an illustration of the display of FIG. 1 after a further spin of the reels from that shown in FIG. 3. The bonus indicators for the remaining three reels are all activated due to the star symbol being present on these reels. Note that the bonus indicator for the middle reel and the far right-hand reel also remain active even though they do not currently display the star symbol. Since all five bonus indicators are active, bonus play is then awarded.

As illustrated in FIGS. 1, 2, 3, and 4, the progress towards the award of the bonus game was displayed to the player—in FIG. 1, there was no progress (none of the indicators (20) were active), in FIG. 2 the player was 1/5 of the way towards the bonus game (one of five indicators (20) active), in FIG. 3 the player was 2/5 of the way towards the bonus game (two of the five indicators (20) active), and in FIG. 4 the player made it all the way since all five of the indicators (20) became active.

After the trigger conditions for bonus play has been met (situation in FIG. 4), the game will typically transition immediately into a bonus game mode. The particular bonus game that is provided to the player at that point may vary widely and is not particularly important. The bonus game may take the form of free spins of the underlying reel-type game, free spins of a new type reel-type game, a "pick until pop" type game, or any other form. Additionally, the player may be given the option to postpone the play of the bonus game until later.

Once the bonus game terminates, all of the reel indicators (20) become inactive. The player then has to accumulate the symbol (22) in the five reels again to initiate the bonus game as before, and the player's progress towards a new award of a bonus game is presented using the indicators (20) in the manner described above.

In the above embodiment, the essence of the triggering mechanism is that active reel indicators (20) are accumulated over time as game play progresses and the bonus game is triggered with the total number of active reel indicators (20) meets a threshold, five in this example. It is anticipated that player interest in the video slot game will be sustained, particularly in circumstances where a player has accumulated a substantial proportion of the reel indicators required to trigger the bonus game.

Clearly, numerous variations and permutations are possible to this embodiment without departing from the scope of the invention. For example:

1. In the above example, the bonus indicators (20) may be accumulated in any order. In an alternative embodiment, the indicators may only be accumulated sequentially, either from left to right or from right to left.
2. Instead of requiring accumulation of all the bonus indicators, it may only be necessary to accumulate a subset of, say, any three reel indicators in order to trigger the bonus game. The bonus trigger will normally require at least two reel indicators to become active, in which case notice of progression is provided to the player when one of the indicators becomes active.
3. A bonus indicator (20) may become activated when a passport symbol (22) occurs in any position in the viewable portion of the associated slot reel (12) instead of only on the centre pay line position (line 23 in FIG. 2).
4. The symbol set of the video slot game may also include a deactivation symbol, e.g., the word "bonus" with a line through it. When the deactivation symbol appears on a reel with an active reel indicator (20), that reel indicator (20) is then deactivated.
5. At the commencement of a playing session, all reel indicators (20) are inactive. Alternatively, in order to encourage a player to return to the game, all reel indicators active at the end of a playing session could be carried forward to the player's next playing session. In other words, when a player plays the game and accumulates one or more active reel indicators (20), the reel indicators are "banked" until the player logs back in and continues playing the game. The "banking" of the reel indicators can take the form of storing data in memory local to the machine indicating the identity of the player and the state of the reel indicators at the time of termination of play. Such information may also be stored in a gaming server that functions to generate results of play and transmits results of play to the player's game playing machine.

Game Playing Environments

As noted previously, the feature of this disclosure of providing notice of progression towards an award of a bonus game can be implemented in a variety of game playing formats. Several representative examples of these formats will be described in this section.

In one format, a personal computer is loaded with game playing software which includes a reel-type game. The game can be played solely for amusement, in which case the computer is typically not interacting with any external resource which logs wagers, determines and communicates results, or adjusts a player's credit account. The game software presents the reels such as shown in FIGS. 1-4 and the bonus progression indicators (20). When a "passport symbol" (22) is present on the pay line, the associated indicator for that reel become active as described above. The software for the game transitions into a bonus game when the required number of bonus indicators (20) become active, e.g., all of them as in the example of FIG. 4.

Figure 5:
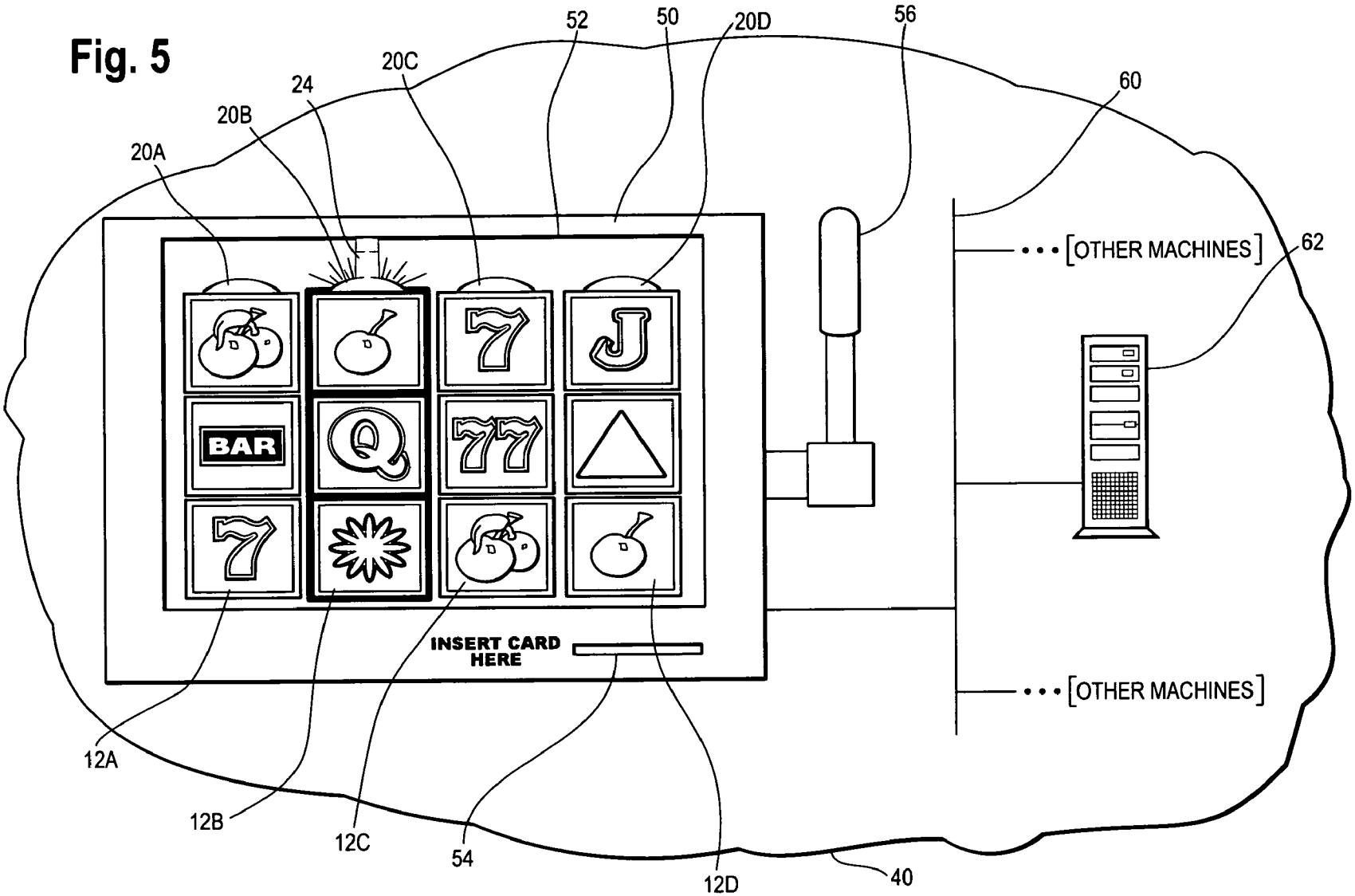
FIG. 5 is an illustration of an environment in which the game shown in FIGS. 1-4 can be played by a video gaming terminal in a casino or like establishment. In the embodiment of FIG. 5, the video gaming terminal is shown connected to a gaming server over a local area network.

In another format, the game may be played in a video gaming terminal, such as found in a land or ship-borne casino. One example of this embodiment is shown in FIG. 5. A casino (40) includes a plurality of game playing machines (50) (in this example, four reel video slot machines) which are connected to a local area network (60). A player inserts a card having a magnetic strip storing a credit amount into a slot (54) in the machine (50). The card is read and wager amounts are deducted from the value carried by the card. The machine (50) includes a display (52) showing four reels (12). The display (52) may also include features which are not shown, such as wager controls, which are conventional and not important. The reels (12) each have an associated bonus progression indicator (20A, 20B, 20C and 20D) as described previously. The indicator (20B) has become active as indicated in FIG. 5 due to the star symbol (22) being present in the bottom position of the reel (12B). A turn of the game is made by pulling on the handle (56) or by pressing a spin button, or in some other fashion.

In this example, the results of play are generated by a gaming server (62) using a random number generator (or other process to generate a set of reel symbols randomly). The gaming server communicates the results of play to the video gaming terminal (50) over the network (60) as a packet or datagram containing data indicating which symbols are to be displayed on the reels (12). The datagram is processed by software resident on the video gaming terminal (50) and presented on the display (52) in known fashion. When the server's randomly generated results include the star symbol (22), the server includes with the datagram containing the results of the spin a flag or bit which is indicates that the indicator (20B) is to become active, since one of the results for reel (12B) is the star symbol (22). Alternatively, the software resident in the terminal (50) may include logic or code which searches the datagram for a data indicating that the star symbol was returned as a result, and if it finds such data the indicator (20B) for the associated reel (12B) is activated.

In this example, suppose the player accumulated two indicators towards an award of bonus play and decided to play poker at a table in the casino (40), or some other wager game on a different machine (50). The player's accumulated progress towards a bonus game result is stored in the gaming server (62) or, alternatively, locally on the player's magnetic card. The player ejects their card from the slot (54) and then proceeds to play wager games elsewhere in the casino. At a later time, they may return to a machine (50) (need not be the same machine they previously played at) and insert their card. The card includes a unique code such as a card number which is correlated at the server (62) with the stored results when the player previously exited the game. The display of the reels reverts to the display of the progression towards an award of a bonus game that was present when the player previously exited the game on the previous machine (50). In this example, the reel indicator (20B) is highlighted and the player continues towards the award of the bonus game where they left off. In one variation, the progression towards bonus play is not carried over and when they exit the play on the machine (50) any accumulated progression towards an award of a bonus game is lost.

Aspects for this invention are also particularly suited for use in the context of playing of wager games over a computer network.

Figure 6:
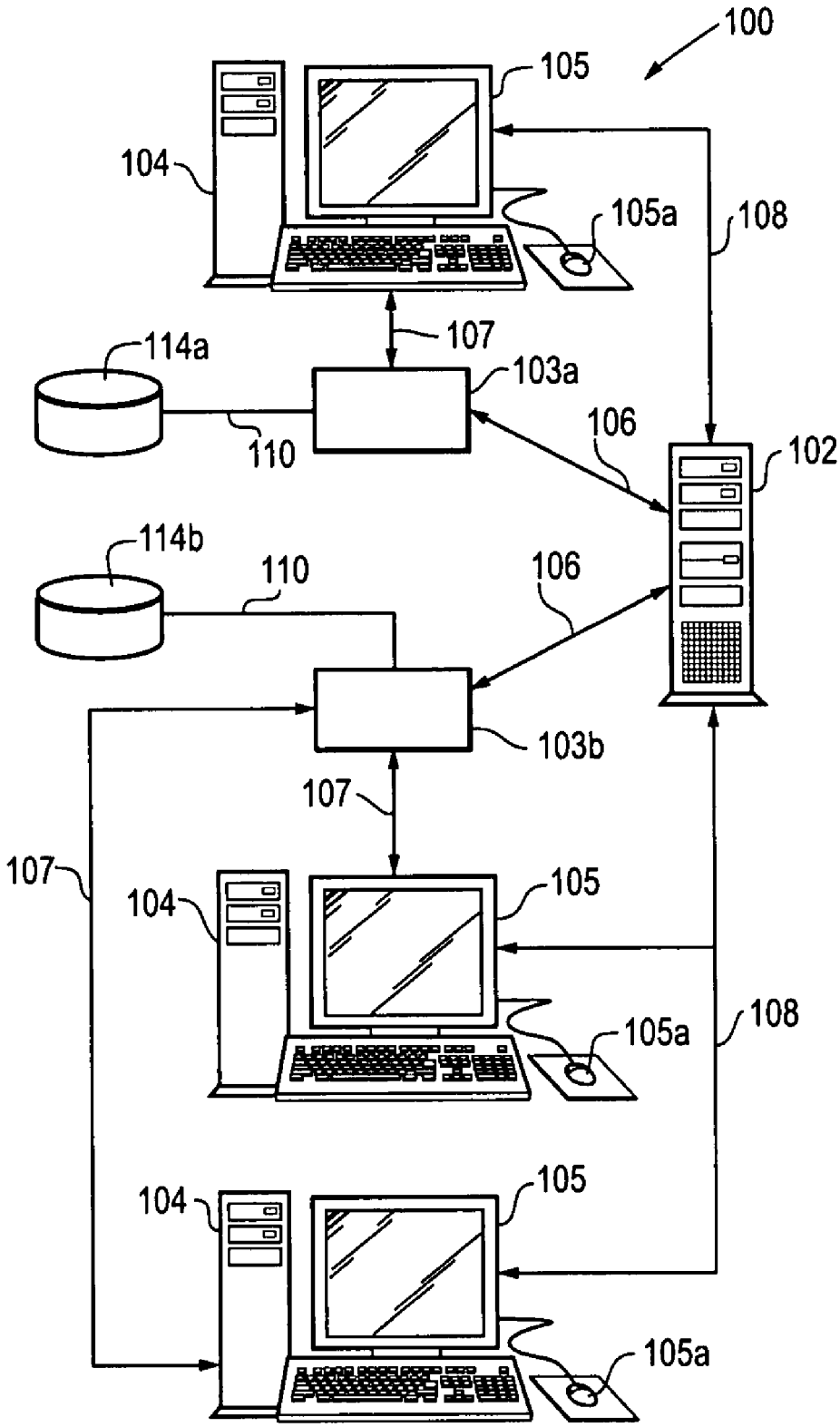
FIG. 6 is an is an illustration of an environment in which the game shown in FIGS. 1-4 can be played by computer workstations connected to a gaming server over a wide area network such as the Internet.

Referring to FIG. 6, a gaming system suitable for use in wager games and promotions of this disclosure is indicated generally by reference numeral (100). The gaming system (100) includes a central gaming server (2), and a number of portals (103*a*, 103*b*) in the form of portal websites on the World Wide Web of the Internet. In this embodiment, each one of the portal websites is an online casino website hosted on a corresponding casino web server (not shown). For convenience, embodiments of the invention will be described with particular reference to only two such online casino websites (103*a*, 103*b*). Other online casino websites may be present, or, alternatively, just one casino website may be present.

Each one of the online casino websites (103*a*, 103*b*) is accessible by a would-be player (not shown) through a player gaming workstation (104) in the form of an Internet-enabled computer workstation (e.g., general purpose computer) having a display monitor (105) and an associated pointing device (105*a*) such as a mouse or, alternatively, a touchpad. In this embodiment, online casino website (103*a*) is shown as having one computer workstation (104) logically connected thereto, whereas casino website (103*b*) is shown as being logically connected to two computer workstations (104). It will be appreciated by those skilled in the art that such online casino websites (103*a*, 103*b*) can be logically connected to any desired number of such computer workstations (104) simultaneously, which number is physically limited only by considerations of processing power and Internet access bandwidth.

The gaming server (102), the online casino web servers (not shown) corresponding to the online casino websites (103*a*, 103*b*), and the computer workstations (104) are capable of communicating with each other by means of an open communication network that is, in this embodiment, the Internet. The Internet is represented in FIG. 6 as separate logical communication networks (106, 107, 108, 110). The particular networking topology used and presence of intermediate networks or switching equipment is not important, and may make use of intervening communications network such as the public switched telephone network, cable networks, cellular wireless networks, WiFi, WiMax, etc.

Each online casino operates an account facility (114*a* and 114*b*, respectively) with a credit account corresponding to each player who participates in a game offered by the online casino. In the illustrated embodiment, therefore, the credit account facility (114*a*) has one player credit account associated with it, while credit account facility (114*b*) has two associated, but separate, player credit accounts.

A stored workstation program (not shown) is resident in the client computer workstation (104) which enables a participating player to browse a casino website and to interact with the gaming server (102) to play wager games such as slots, poker, Black Jack, Roulette and other games. The stored workstation program includes display tools for displaying on the user interface display (105) gaming symbols (e.g., slot machine reels, cards, Roulette wheels, etc.), display gaming controls by which the player can place wagers, spin the reels, etc., and display the results of play. The stored workstation program also includes gaming logic for facilitating the execution of a turn of a game, and communications facilities for communicating player actions using the user interface to the central gaming server, and receiving datagrams from the gaming server containing results of play. The data representing results of play is translated to graphical symbols which are presented on the user interface display (105). Further details are known in the art and described in the patent literature, see e.g., U.S. application Ser. No. 10/550,744 filed Sep. 23, 2005.

Each computer workstation (104) may take the form of a conventional personal computer operating under a Windows XP, ME, 2000 or other operating system, which is well known and commercially available from Microsoft Corporation of Redmond, Wash., or other operating system such as provided by Apple Computer or a Linux operating system. The gaming workstation may also take the form of a portable computing device such as personal digital assistant or cellular telephone. The gaming workstation may also take the form of an electronic gaming terminal.

The gaming server (102) operates under control of a server-stored program (not shown) that co-operates with the stored workstation program in order to enable a player at the computer workstation (104) to play a wager game. The gaming server (102) operates, for example, under the Windows NT operating system.

The stored workstation program or application (not shown) and the corresponding stored server program will be referred to, for convenience, as a client process and a server process, respectively. The server process generates one or more random events that determine the outcome of turns of the game, such as determining the outcome of spins of the slot machine reels in the various slots games of the participating players. The client process of any particular computer workstation (104) obtains the result of the random events from the gaming server (102) along the communication network (108) and displays the outcome of the game on the display monitor (105) of the workstation in an intelligible manner, by causing the player's set of slots reels to spin and to come to rest at a position corresponding to the outcome. If a slot machine reel includes a symbol associated with an award of progress towards a bonus game, such as the star symbol of FIG. 5 or the "passport" symbol (22) of FIG. 2, then the indicator (20) for the associated reel (12) become active. As noted, the instruction to activate the indicator (20) could come from the server (102) in the form of a flag or bit in the datagram with the results of the spin, or alternatively the workstation program may detect the presence of the bonus symbol in the datagram and activate the indicator (20).

The gaming server (102) thus generates results of spins of the reels for the workstations (104) and sends datagrams to the workstations indicating such results. In one possible embodiment, to generate the results of a spin of the reels, the gaming server (102) includes a memory (not shown, but conventional) storing data representing potential results for each of the reels. The gaming server uses a random process (e.g., random number generator) to select one of the results from memory. One of the results stored in the gaming server memory is data representing a result in the form of a symbol which is associated with progress towards an award of a bonus game, e.g., the flower or star symbol (22) shown in FIGS. 1-5. The memory may also store data representing a potential result in the form of a deactivation symbol (e.g., the letter B or the word "Bonus" with a line through it). Should the deactivation symbol be returned, any previous progress towards an award of bonus game associated with the reel having such deactivation symbol is negated or lost.

The gaming server can also "bank" the progress made towards a bonus game in the event that a player ceases playing the reel-type game, e.g., logs out of the casino or elects to play other games such as poker. The gaming server is further provided with a memory storing data (e.g., a flag or bit) indicating whether a result of a spin of the reels for the workstation has included the symbol associated with progress towards the bonus game. The flag or bit may further identify which reel the symbol appeared in. The gaming server stores such data in the memory after the workstation has ceased play of the game. Should the player return to playing the reel-type game, the gaming server (102) consults the memory and returns a datagram to the player's workstation which includes such data. The player's workstation display then shows the accumulated or "banked" progress towards the bonus game (e.g., illumination of the associated bonus indicators that were previously activated) and starts play where they previously left off.

In order to play the games from any particular computer workstation (104), the client process (not shown) must first be downloaded to that computer workstation from the gaming server (102) or, alternatively, from a separate web server (not shown), and then installed on the workstation.

In use, a player wishing to participate in a wager game uses a computer workstation (104) to access an online casino website (103*a*, 103*b*) of his choice. When the player navigates using a Web browser to a home page of a casino, a promotional message may be displayed (described below). The player is presented with an icon on the GUI on his computer workstation (104), which the player can activate in order to download the client process and register with the casino operator. Following these tasks, the player may request to play games provided on the casino website by clicking on an appropriate icon or taking other similar action.

The online casino websites (103*a*, 103*b*) may be provisioned as a virtual slots room where slots is the only game available to would-be players, rather than one where a variety of different games are offered to a player.

It will be noted again that a system implementing the methods of this invention need not include two (or more) separate casino websites (103*a*, 103*b*), and that only one website (103) may be linked to the gaming server (102).

In one possible embodiment, the method of playing that game of this disclosure may be such that a first bonus game is triggered when the symbol associated with the bonus game has occurred during the course of play in less than N reels and wherein a second bonus game is triggered when the symbol has occurred during the course of play in all of the N reels.

As used herein, the term "reel" is intended to be interpreted to include any device displaying one or more symbols in which the one or more symbols displayed are randomly determined.

Variation from the disclosed embodiments may of course be made without departure from the scope of the invention. All questions concerning scope are to be answered by reference to the appended claims.

The invention claimed is:

1. A machine configured to enable a player to play a reel-type wager game featuring a bonus game awarding scheme played over successive spins, comprising:

a display configured to display two or more reels of a reel-type wager game;

a memory storing software instructions for facilitating a user to play the reel-type wager game; and a processor for executing the software instructions;

wherein the software instructions comprise displaying on the display a bonus indicator associated with each of the two or more reels, each of the two or more reels having its own corresponding bonus indicator, the bonus indicator changes from a first state to a second state to indicate the bonus indicator becoming active and remains in the second state when the respective reel displays a result from a spin of the respective reel comprising a symbol associated with an award of a bonus game;

the bonus game being awarded when at least two of the reels' corresponding bonus indicators are in the second state, and wherein the active bonus indicators are accumulated progressively over the successive spins of the game to thereby allow the player to progress towards the award of the bonus game;

and wherein, for a reel in which the bonus indicator for such reel has already become active, a subsequent result of a spin comprising the symbol associated with an award of a bonus game does not advance the player further towards the award of a bonus game.

2. The machine of claim 1, wherein the machine is connected to a computer network and wherein the machine is configured to receive results of spins of the reels from a gaming server over the computer network.

3. The machine of claim 2, wherein the instructions further comprise instructions which examine data representing the results for a spin of a game for the presence of a data indicating a symbol associated with an award of the bonus game.

4. The machine of claim 1, wherein the machine comprises a video gaming terminal.

5. The machine of claim 1, wherein the display is configured to display N reels, where N is an integer greater than three, each of the reels having an associated bonus indicator.

6. The machine of claim 5, wherein the results for the reel-type game are displayed in the form of an array of symbols in M rows and N columns, wherein a bonus indicator is associated with each of the N columns.

7. The machine of claim 6, wherein the bonus indicator for a given column becomes active when the symbol associated with a bonus game is present in any of the M rows in the column.

8. The machine of claim 1, wherein the bonus indicator comprises a graphical symbol presented on the display adjacent to each of the reels.

9. In a gaming server communicating with a machine enabling a player to play a reel- type game having two or more reels over a computer network, the gaming server generating results of a spin of each of a plurality of reels in the reel-type game for the machine and transmitting such results to the machine as a datagram over the computer network, the improvement comprising:

the gaming server containing a memory storing data representing potential results for each of the reels including a result comprising a symbol which is associated with progress towards an award of a bonus game;

wherein each of the reels has its own corresponding bonus indicator, the bonus indicator changes from a first state to a second state to indicate the bonus indicator becoming active and remains in the second state when the respective reel displays a result from a spin of the respective reel comprising a symbol associated with an award of a bonus game;

wherein the bonus game is awarded when at least two of the reels' corresponding bonus indicators are in the second state, and wherein the active bonus indicators are accumulated progressively over successive spins of the game to thereby allow the player to progress towards the award of the bonus game; and wherein, for a reel in which the bonus indicator for such reel has already become active, a subsequent result of a spin comprising the symbol associated with an award of a bonus game does not advance the player further towards the award of a bonus game.

10. The improvement of claim 9, wherein the gaming server is further provided with a memory storing data indicating whether a result of a spin of the reels for the machine has included the symbol, wherein the gaming server stores such data in the memory after the workstation has ceased play of the game.

11. The improvement of claim 9, wherein the potential results for each of the reels further includes a result comprising a deactivation symbol, wherein the bonus indicator associated with the reel having such deactivation symbol is deactivated to the first state.

12. The improvement of claim 9, wherein the results for the reel-type game are displayed in the form of an array of symbols in M rows and N columns.

13. The improvement of claim 9, wherein the reel-type game is played with N reels, where N is an integer greater than or equal to three, and wherein a bonus game is triggered when the symbol has occurred during the course of play in less than N reels.

14. The improvement of claim 13, wherein a first bonus game is triggered when the symbol has occurred during the course of play in less than N reels and wherein a second bonus game is triggered when the symbol has occurred during the course of play in all of the N reels.

15. A method of playing a reel-type game using a machine having a display, comprising the steps of:

providing on the display a plurality of reels; and providing a trigger mechanism for initiation of a bonus game in which the required trigger conditions are accumulated progressively over multiple tums of the game;

wherein the trigger mechanism comprises a bonus indicator associated with each of the plurality of reels, each reel having its own bonus indicator;

conducting turns of play of the reel-type game by causing the reels to spin and activating a bonus indicator associated with a given reel by changing said bonus indicator from a first state to a second state and maintaining said bonus indicator in the second state if a symbol associated with the bonus game appears on the given reel; and initiating the bonus game if and when at least two of the reels' corresponding bonus indicators are in the second state;

and wherein, for a reel in which the bonus indicator for such reel has already become active, a subsequent result of a spin comprising the symbol associated with an award of a bonus game does not advance the player further towards the award of a bonus game.

16. The method of claim 15, wherein the display is configured to display N reels, where N is an integer greater than or equal to three, and wherein each of the reels has an associated bonus indicator.

17. The method of claim 16, wherein the results for the reel-type game are displayed in the form of an array of symbols in M rows and N columns, wherein a bonus indicator is associated with each of the N columns.

18. The method of claim 17, wherein the bonus indicator for a given column becomes active when the symbol associated with a bonus game is present in any of the M rows in the column.

19. The method of claim 16, wherein the bonus indicator comprises a graphical symbol presented on the display adjacent to each of the reels.

20. The method of claim 15, wherein the bonus indicator remains in the second state in a subsequent turn of the reel-type game regardless of whether such subsequent turn includes as a result the symbol associated with the bonus game.

21. The method of claim 15, further comprising the step of banking any accumulated progress towards the award of the bonus game upon exiting from play of the game.

22. The method of claim 15, further comprising the step of including in the game a deactivation symbol, wherein in an event that a turn of play resulted in the deactivation symbol in a given reel the corresponding bonus indicator for the given reel deactivates to the first state.

* * * * *